US006695626B1

(12) United States Patent
Chih

(10) Patent No.: US 6,695,626 B1
(45) Date of Patent: Feb. 24, 2004

(54) ELECTRICAL CONNECTOR ASSEMBLY WITH DURABLE MATING CONNECTORS

(75) Inventor: Kuo-Hua Chih, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/392,059

(22) Filed: Mar. 18, 2003

(51) Int. Cl.[7] ..... H01R 12/00
(52) U.S. Cl. ..... 439/74
(58) Field of Search ..... 439/74, 660, 83

(56) References Cited

U.S. PATENT DOCUMENTS 6,106,306 A * 8/2000 Koga et al. ..... 439/74
6,159,021 A 12/2000 Kusuhara

FOREIGN PATENT DOCUMENTS

TW 371526 10/1999

* cited by examiner

*Primary Examiner*—Tho D. Ta
(74) *Attorney, Agent, or Firm*—Wei Te Chung

(57) ABSTRACT

A board-to-board connector assembly (1) is for electrically interconnecting two circuit substrates. The connector assembly includes a first electrical connector (2) having a first housing (20), and a second electrical connector (4) having a second housing (40). The first housing includes a pair of first end walls (24) and an island (26). The second housing includes a pair of second end walls (49), and a cavity for receiving the island of the first connector therein. Each second end wall defines an opening (492) in a portion thereof distal from a main body of the second housing. Each second end wall also defines a recess (494) adjoining an outer main face thereof. When the first and second connectors are connected or disconnected at a slight angle relative to each other, interference therebetween can be eliminated.

19 Claims, 6 Drawing Sheets

ELECTRICAL CONNECTOR ASSEMBLY WITH DURABLE MATING CONNECTORS

BACKGROUND OF THE INVENTION

1. Field of the Invention

The present invention relates to an electrical connector assembly, and particularly to a board-to-board connector assembly for electrically interconnecting two circuit substrates such as printed circuit boards (PCBs).

2. Description of Prior Art

FIG. 7 shows a conventional board-to-board connector assembly 6 which is disclosed in Taiwan Patent Issue No. 371526. The connector assembly 6 comprises a first electrical connector 61 and a second electrical connector 62. The first connector 61 comprises a first longitudinal insulative housing 610, and a plurality of first electrical terminals 612 received in the first housing 610. The first housing 610 defines a longitudinal cavity therein. A pair of first end walls 614 is defined at opposite ends of the cavity respectively. The second connector 62 comprises a second longitudinal insulative housing 620, and a plurality of second electrical terminals 622 received in the second housing 620. The second housing 620 defines a longitudinal slot 624 therein. An island 626 is formed in the slot 624, and a pair of second end walls 628 is formed at opposite ends of the slot 624 respectively. When the first connector 61 and the second connector 62 are connected or disconnected at a slight angle, the first end walls 614 interfere with respective major portions of the second end walls 628 that are distal from a main body of the second housing 620. The first end walls 614 also interfere with a major portion of the island 626 that is distal from a main body of the second housing 620. Because of friction between the first end walls 614 and said major portions of the second end walls 628, and of friction between the first end walls 614 and said major portion of the island 626, the first connector 61 cannot be smoothly and conveniently connected to or disconnected from the second connector 62. Thus, the first end walls 614, the second end walls 628 and the island 626 are prone to be damaged.

Another conventional board-to-board connector assembly which is disclosed in U.S. Pat. No. 6,159,021 is similar to the conventional board-to-board connector assembly 6 described above, except that a second electrical connector does not have a pair of second end walls. When a first connector and the second connector are connected or disconnected at a slight angle, first end walls of the first connector interfere with a major portion of an island of a second housing of the second connector that is distal from a main body of the second housing. Because of friction between the first end walls and said major portion of the island, the first connector cannot be smoothly and conveniently connected to or disconnected from the second connector. Thus, the first end walls and the island are prone to be damaged.

In view of the above, a new board-to-board connector assembly that overcomes the above-mentioned disadvantages is desired.

SUMMARY OF THE INVENTION

Accordingly, an object of the present invention is to provide an electrical connector assembly such as a board-to-board connector assembly for electrically interconnecting two circuit substrates such as printed circuit boards (PCBs) such that when connectors of the connector assembly are connected or disconnected, interference therebetween is minimized.

To achieve the above-mentioned object, a board-to-board connector assembly in accordance with a preferred embodiment of the present invention is for electrically interconnecting two PCBs. The connector assembly comprises a first electrical connector and a second electrical connector. The first connector comprises a first longitudinal insulative housing, and a plurality of first electrical terminals received in the first housing. The first housing defines a longitudinal slot therein. An island is formed in the slot, and a pair of first end walls is formed at opposite ends of the slot respectively. The second connector comprises a second longitudinal insulative housing, and a plurality of second electrical terminals received in the second housing. The second housing defines a longitudinal cavity for receiving the island of the first connector therein. A pair of second end walls is formed at opposite ends of the cavity. Each second end wall defines an opening in a portion thereof distal from a main body of the second housing. Each second end wall also defines a recess adjoining an outer main face thereof. When the first and second connectors are connected or disconnected at a slight angle relative to each other, interference therebetween can be eliminated.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
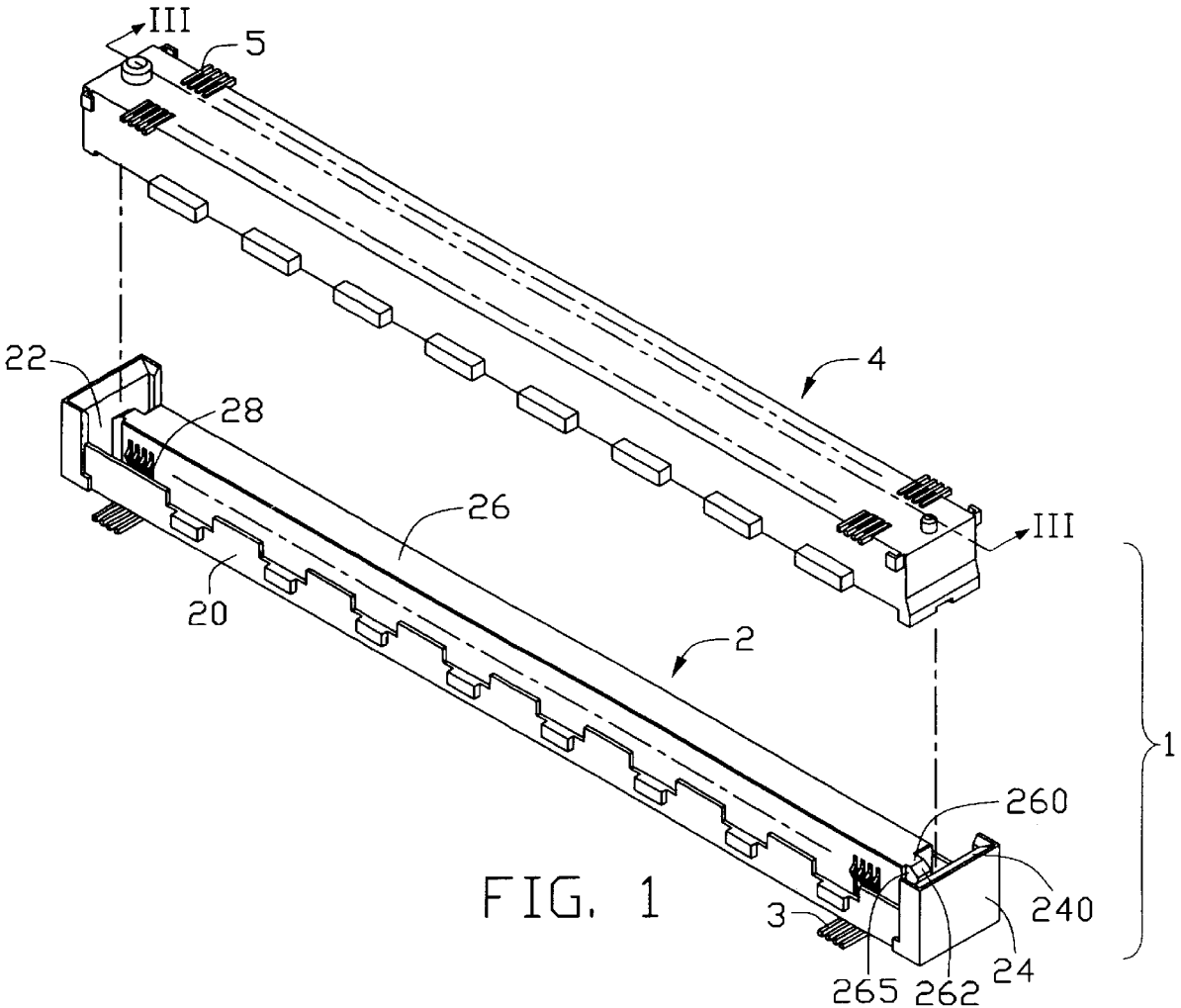
FIG. 1 is a simplified, exploded isometric view of a board-to-board connector assembly in accordance with a preferred embodiment of the present invention.
Figure 2:
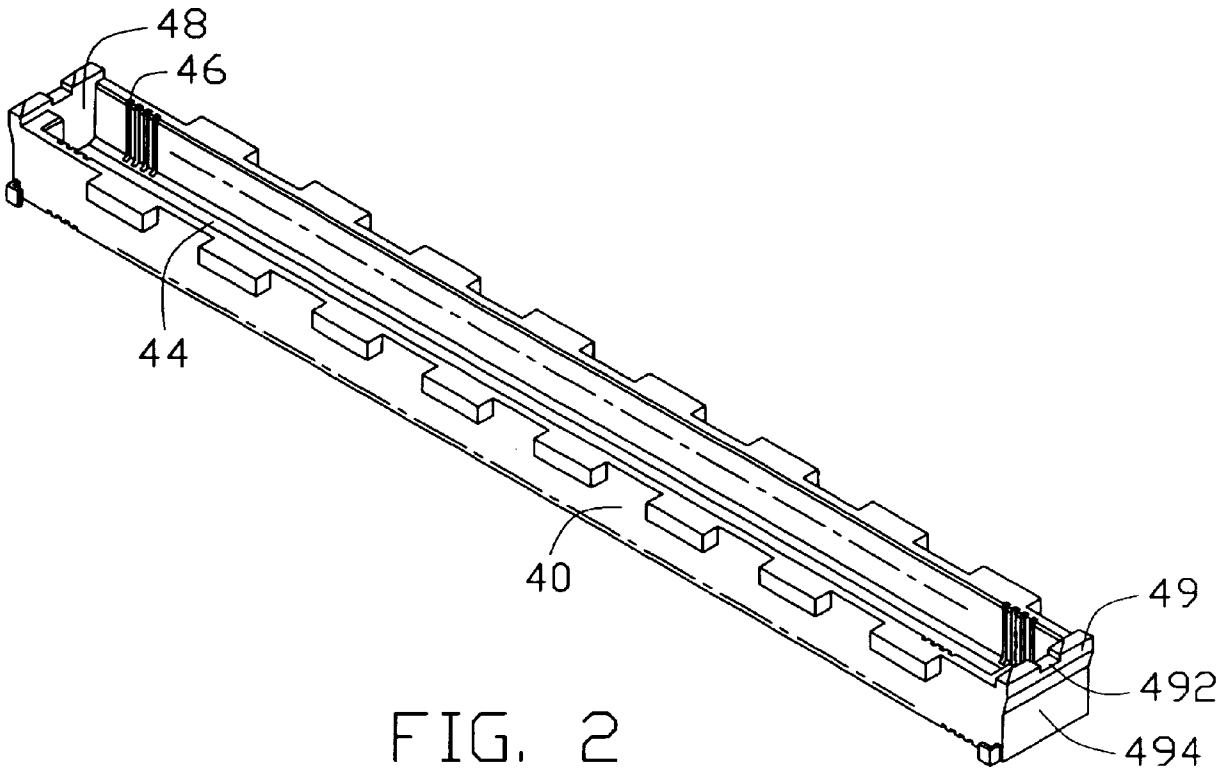
FIG. 2 is an isometric view of a second connector of the connector assembly of FIG. 1, but showing the second connector inverted.

Referring to FIGS. 1 and 2, a board-to-board connector assembly 1 in accordance with a preferred embodiment of the present invention is for electrically interconnecting two printed circuit boards (PCBs) (not shown). The connector assembly 1 comprises a first electrical connector 2 and a second electrical connector 4. The first connector 2 comprises a first longitudinal insulative housing 20, and a plurality of first electrical terminals 3 received in the first housing 20. The first housing 20 defines a longitudinal slot 22 therein. An island 26 is formed in the slot 22, and a pair of first end walls 24 is formed at opposite ends of the slot 22 respectively. Each first end wall 24 forms a slanted leading surface 240 on a top portion thereof, for facilitating entry of the second connector 4 into the first connector 2. The island 26 defines a plurality of first through holes 28 in opposite sides thereof, the first through holes 28 receiving the first terminals 3 therein. The island 26 forms a pair of protrusions 260 at opposite ends thereof respectively. A concave space 265 is defined where each protrusion 260 adjoins a main portion of the island 26. This provides each protrusion 260 with a corresponding narrowed width. Each protrusion 260 forms an inclined plane 262. The inclined planes 262 are for facilitating entry of the second connector 4 into the first connector 2.

The second connector 4 comprises a second longitudinal insulative housing 40, and a plurality of second electrical terminals 5 received in the second housing 40. The second housing 40 defines a longitudinal cavity 44 for receiving the island 26 of the first connector 2 therein. A pair of second end walls 49 is formed at opposite ends of the cavity 44. A plurality of second through holes 46 is defined in longitudinal walls of the second housing 40 at opposite sides of and in communication with the cavity 44, the second through holes 46 receiving the second terminals 5 therein. A pair of gaps 48 is defined at opposite ends of the cavity 44 at respective second end walls 49, for receiving the protrusions 260 of the first connector 2 therein. A width of each gap 48 is greater than a corresponding width of the corresponding protrusion 260 of the first connector 2. Each second end wall 49 defines an opening 492 in a portion thereof distal from a main body of the second housing 40. A width of each opening 492 is greater than a corresponding width of either protrusion 260. Each second end wall 49 also defines a recess 494 adjoining an outer main face thereof. A distance 'b' spanning between outmost portions of the respective main faces of the second end walls 49 is greater than a distance 'a' spanning between the recesses 494 of the second end walls 49 (see FIG. 3).

Figure 3:
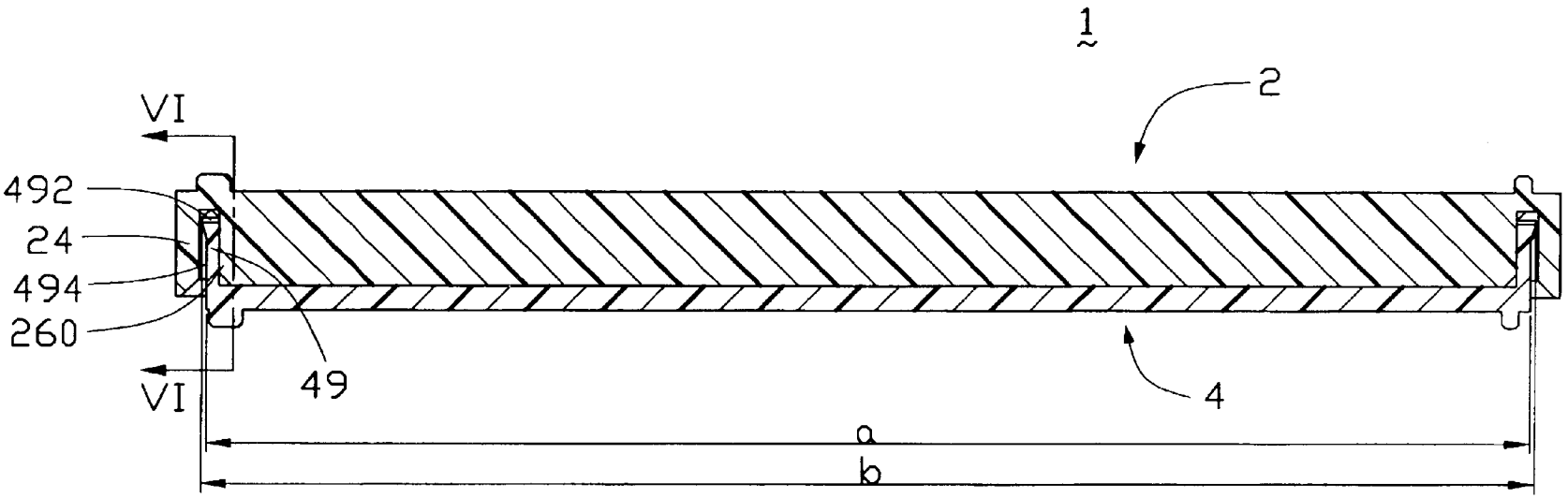
FIG. 3 is a cross-sectional view taken along line III—III of the connector assembly of FIG. 1, but showing the connector assembly fully assembled and inverted.

In assembly of the connector assembly 1, the protrusions 260 of the first housing 20 are mated in the gaps 48 of the second housing 40. This ensures that the first connector 2 and the second connector 4 are correctly assembled together. Referring to FIG. 3, the first housing 20 of the first connector 2 is received in the cavity 44 of the second connector 4, and the first terminals 3 electrically connect with the second terminals 5. Thus the two PCBs are electrically interconnected.

Figure 5:
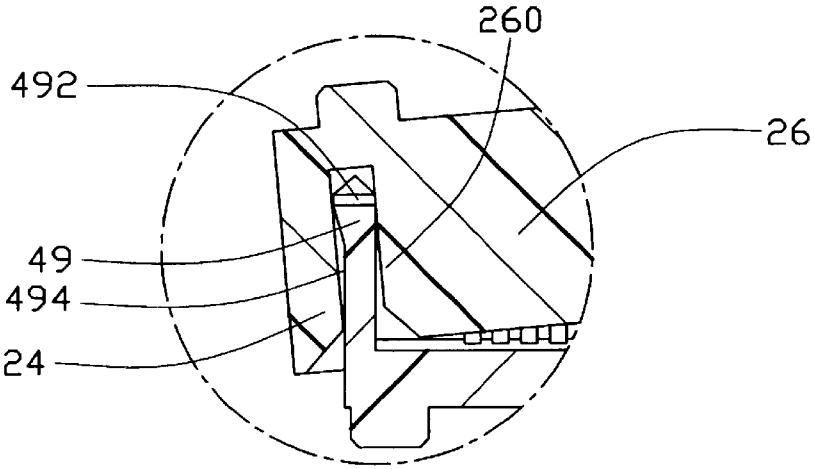
FIG. 5 is an enlarged view of a circled portion V of FIG. 4.
Figure 4:
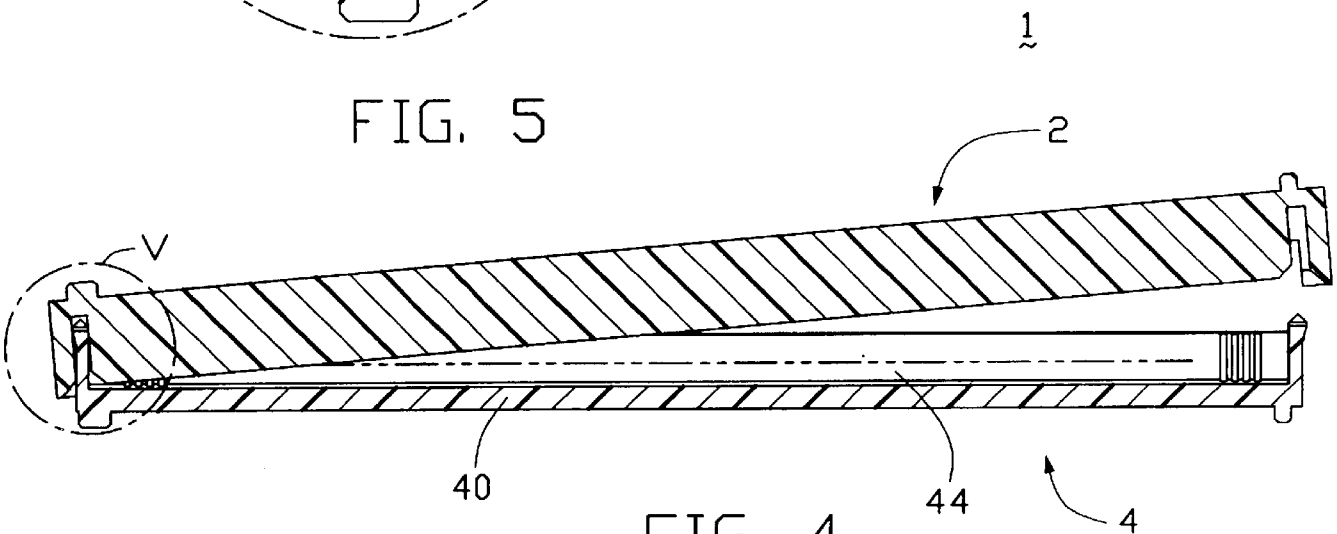
FIG. 4 is similar to FIG. 3, but showing a first connector and the second connector of the connector assembly partly connected at a slight angle.

Referring to FIGS. 4 and 5, the first connector 2 can be inserted into the second connector 4 at a slight angle. In this way, the second end walls 49 of the second connector 4 are sequentially engaged in the first connector 2. Referring particularly to FIG. 5, because the second end wall 49 has the recess 494, the second end wall 49 can be inserted without interfering with a major portion of the first end wall 24 that is distal from a main body of the first housing 20. Furthermore, because the second end wall 49 has the opening 492, the second end wall 49 can be inserted without interfering with a major portion of the protrusion 260 that is distal from the main body of the first housing 20.

Figure 6:
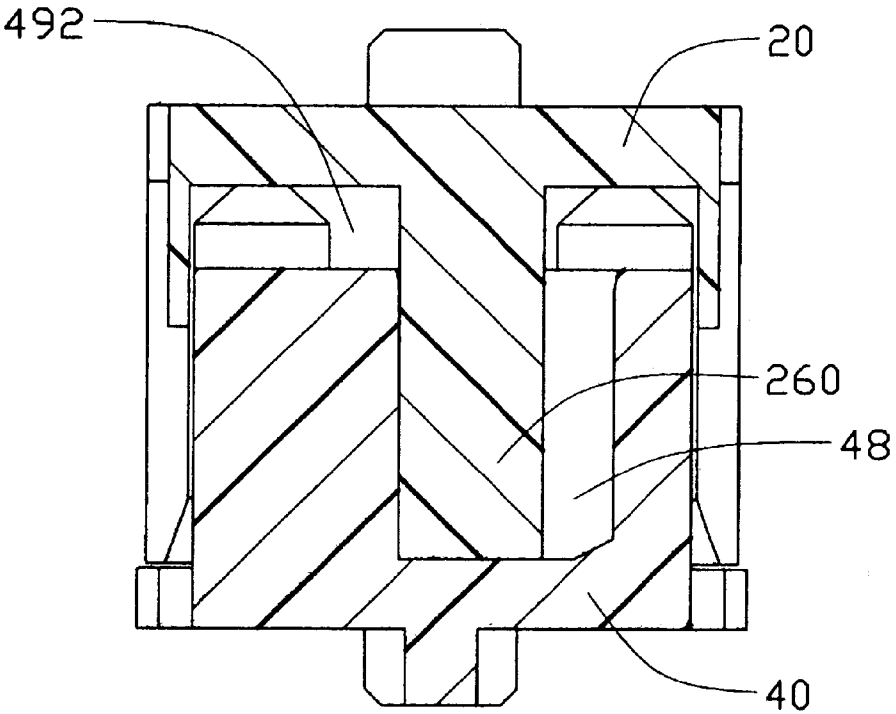
FIG. 6 is a cross-sectional view taken along line VI—VI of FIG. 3.
Figure 7:
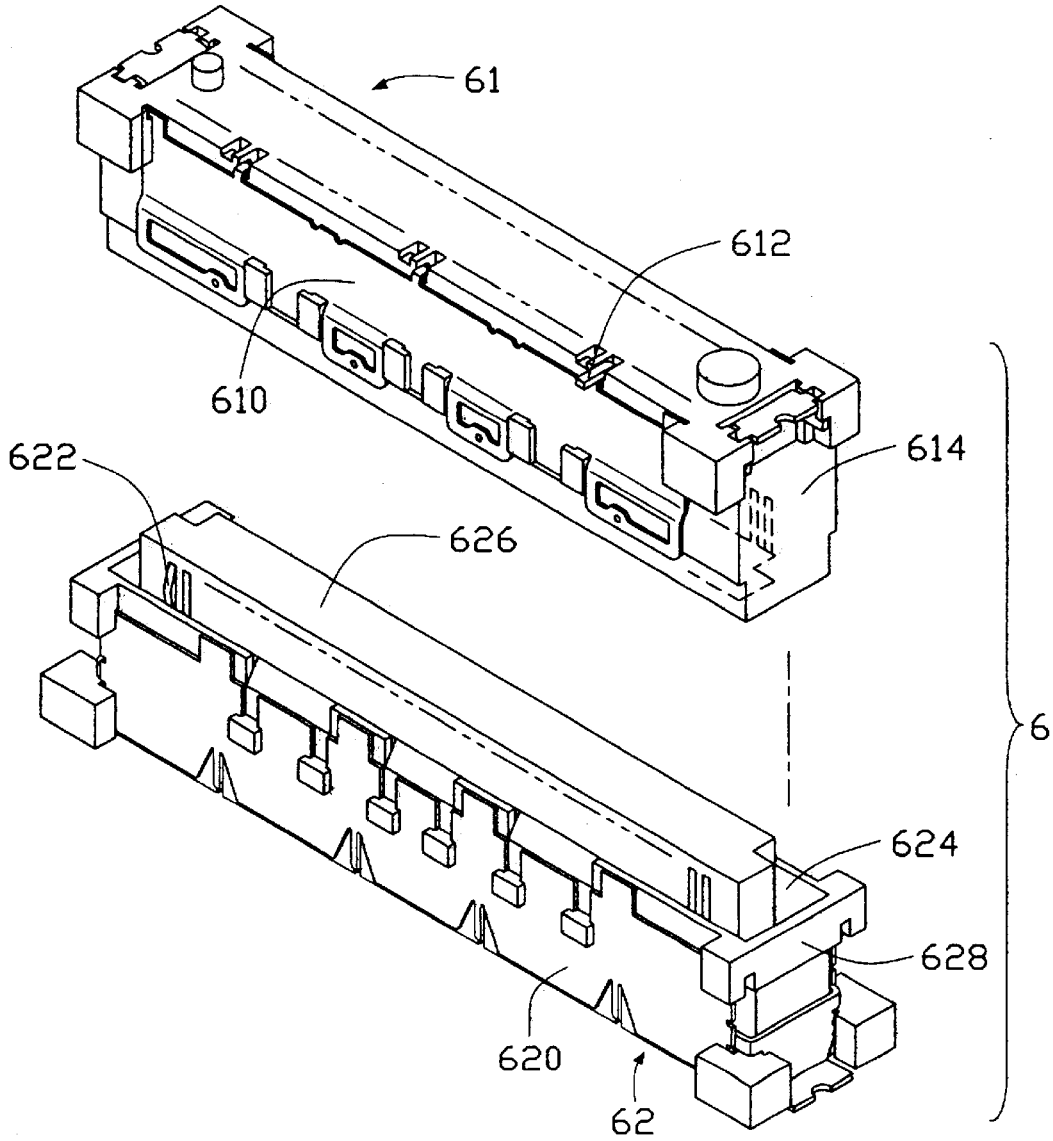
FIG. 7 (PRIOR ART)
FIG. 7 is a simplified, exploded isometric view of a conventional board-to-board connector assembly.

When the second connector 4 is fully engaged with the first connector 2, the distal portion of each second end wall 49 is engaged between a corresponding protrusion 260 and a portion of the corresponding first end wall 24 that is proximal to the main body of the first housing 20. Because the distance 'b' is greater than the distance 'a', a space is defined between the second end wall 49 at the recess 494 and the first end wall 24. Furthermore, referring also to FIG. 6, because widths of the gaps 48 of the second housing 40 are greater than the corresponding widths of the protrusions 260 of the first housing 20, the protrusions 260 can be received in the gaps 48 without interfering with a corresponding longitudinal wall of the second housing 40 thereat.

Similarly, when the first connector 2 is disconnected from the second connector 4 at a slight angle, this can be done without interference between the second end walls 49 of the second connector 4 and said major portions of the first end walls 24 of the first connector 2. Further, it can be done without interference between the second end walls 49 and said major portions of the protrusions 260 of the first connector 2.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector assembly for electrically connecting two circuit substrates, the electrical connector assembly comprising:

a first electrical connector comprising a first insulative housing and a plurality of first electrical terminals received in the first housing, a pair of first end walls at opposite ends of the first housing, and an island between the first end walls; and a second connector comprising a second insulative housing and a plurality of second electrical terminals received in the second housing, a pair of second end walls at opposite ends of the second housing, each of the second end walls defining an opening in a portion thereof distal from a main body of the second housing, each of the second end walls further defining a recess adjoining an outer main face thereof; wherein when the first and second connectors are connected or disconnected at a slight angle, interference therebetween can be eliminated;

wherein a distance spanning between outmost distal portions of the second end walls is greater than a distance spanning between the recesses of the second end walls.

2. The electrical connector assembly as claimed in claim 1, wherein each of the first end walls comprises a slanted leading surface on a top portion thereof.

3. The electrical connector assembly as claimed in claim 1, wherein the second housing defines a cavity for receiving the island, and a pair of gaps is defined at opposite ends of the cavity at respective second end walls.

4. The electrical connector assembly as claimed in claim 3, wherein the island comprises a pair of protrusions at opposite ends thereof respectively, a concave space is defined where each of the protrusions adjoins a main portion of the island, and the protrusions are received in the gaps.

5. The electrical connector assembly as claimed in claim 4, wherein a width of each of the openings of the second housing is greater than a corresponding width of either of the protrusions.

6. An insulative housing assembly for an electrical connector assembly, the insulative housing assembly comprising:

a first insulative housing comprising a pair of first end walls at opposite ends thereof, and an island between the first end walls; and a second insulative housing comprising a pair of second end walls at opposite ends thereof, each of the second end walls defining a recess adjoining an outer main face thereof; wherein when the first and second housings are attached or detached at a slight angle, interference therebetween can be eliminated;

wherein a distance spanning between outmost distal portions of the second end walls is greater than a distance spanning between the recesses of the second end walls.

7. The insulative housing assembly as claimed in claim 6, wherein each of the first end walls comprises a slanted leading surface on a top portion thereof.

8. The electrical connector assembly as claimed in claim 6, wherein said recess is located around a root region of the corresponding second end wall.

9. The electrical connector assembly as claimed in claim 6, wherein a chamfer is formed on at least one of said island and the corresponding first end wall along a lengthwise direction for compliance with tilting assembling/disassembling of the second end wall of the second connector.

10. The insulative housing assembly as claimed in claim 6, wherein the second housing defines a cavity for receiving the island, and a pair of gaps is defined at opposite ends of the cavity at respective second end walls.

11. The insulative housing assembly as claimed in claim 10, wherein the island comprises a pair of protrusions at opposite ends thereof respectively, a concave space is defined where each of the protrusions adjoins a main portion of the island, and the protrusions are received in the gaps.

12. The insulative housing assembly as claimed in claim 11, wherein a width of each of the openings of the second housing is greater than a corresponding width of either of the protrusions.

13. An electrical connector assembly for electrically connecting two circuit substrates, the electrical connector assembly comprising:

a first electrical connector comprising a pair of first end walls at opposite ends thereof, each of the first end walls having an inner surface; and a second electrical connector comprising a pair of second end walls at opposite ends thereof, each of the second end walls having a recessed outer surface; wherein when the first connector and the second connector are coupled together, a space is defined between each of the inner surfaces and its corresponding outer surface;

wherein the first connector comprises an island between the first end walls;

wherein a distance spanning between outmost distal portions of the second end walls is greater than a distance spanning between the recessed outer surfaces of the second end walls.

14. The electrical connector assembly as claimed in claim 13, wherein each of the first end walls comprises a slanted leading surface adjacent the inner surface.

15. The electrical connector assembly as claimed in claim 13, wherein each of the second end walls defines an opening in a portion thereof distal from a main body of the second connector.

16. The electrical connector assembly as claimed in claim 13, wherein the second connector defines a cavity for receiving the island, and a pair of gaps is defined at opposite ends of the cavity at respective second end walls.

17. The electrical connector assembly as claimed in claim 16, wherein the island comprises a pair of protrusions at opposite ends thereof respectively, a concave space is defined where each of the protrusions adjoins a main portion of the island, and the protrusions are received in the gaps.

18. The electrical connector assembly as claimed in claim 17, wherein a width of each of the openings of the second connector is greater than a corresponding width of either of the protrusions.

19. An electrical connector assembly comprising:

a first insulative housing defining a lengthwise direction and comprising a pair of first end walls at opposite ends thereof, and an elongated island between the first end walls along said lengthwise direction;

a pair of protrusions formed at two opposite ends of the island; and a second insulative housing comprising a pair of second end walls at opposite ends thereof, each of the second end walls defining an opening at an upper edge thereof, a dimension of said opening being not less than that of the protrusion in a lateral direction perpendicular to said lengthwise direction; wherein when the first and second housings are attached or detached at a slight angle, interference therebetween can be eliminated.

* * * * *